US009779642B2

(12) United States Patent
Ballow

(10) Patent No.: US 9,779,642 B2
(45) Date of Patent: Oct. 3, 2017

(54) PUZZLE SYSTEM WITH DUAL DISPLAY FACES

(71) Applicant: Blue Fondue, LLC, Bellevue, WA (US)

(72) Inventor: Brett Ballow, Bellevue, WA (US)

(73) Assignee: BLUE FONDUE, LLC, Bellevue, WA (US)

( * ) Notice: Subject to any disclaimer, the term of this patent is extended or adjusted under 35 U.S.C. 154(b) by 0 days.

(21) Appl. No.: 14/946,325

(22) Filed: Nov. 19, 2015

(65) Prior Publication Data

US 2016/0140883 A1 May 19, 2016

Related U.S. Application Data

(60) Provisional application No. 62/081,759, filed on Nov. 19, 2014.

(51) Int. Cl.
*G09F 11/02* (2006.01)
*A63F 9/10* (2006.01)

(52) U.S. Cl.
CPC ..... *G09F 11/025* (2013.01); *A63F 9/10* (2013.01)

(58) Field of Classification Search
CPC ..... A63F 9/10; A63F 2009/1005
See application file for complete search history.

(56) References Cited

U.S. PATENT DOCUMENTS 2,037,966 A * 4/1936 Dailey ..... A63F 9/10 273/157 R
2,082,943 A * 6/1937 Dutcher ..... A63F 9/10 273/156
3,011,433 A * 12/1961 Coakley ..... B05C 17/06 101/115
3,540,732 A * 11/1970 Wilson ..... A63F 9/10 273/157 R
3,633,286 A * 1/1972 Maurer ..... B43L 13/206 33/563
3,876,207 A * 4/1975 Jones ..... A63F 3/00694 273/141 A
3,981,505 A * 9/1976 Odier ..... A63F 9/10 273/157 R (Continued)

*Primary Examiner* — Gary C Hoge
(74) *Attorney, Agent, or Firm* — Seed IP Law Group LLP

(57) ABSTRACT

A system having at least one support, a housing mounted on the at least one support, a plurality of panels rotatably mounted in the housing and configured to present first and second display faces, each panel having first and second opposing faces that meet at opposing longitudinal first and second edges, the plurality of panels including a first panel having a portion of a first character removed from the first edge of the first panel, a second panel having a remaining portion of the first character removed from the second edge of the second panel, the first and second panels cooperating so that when the first and second panels are rotated with the respective first and second edges adjacent each other, the portion of the first character on the first panel and the remaining portion of the first character on the second panel cooperate to form a visual display of the complete first character, and a mechanism coupled to the plurality of panels and configured to cause the plurality of panels to rotate in unison in the housing and change the display face.

7 Claims, 11 Drawing Sheets

(56) References Cited

U.S. PATENT DOCUMENTS

| | | | | | |
|---|---|---|---|---|---|
| RE32,004 | E | * | 10/1985 | Clancy | A63F 9/0803 273/153 S |
| 5,362,054 | A | * | 11/1994 | Ashemimry | A63F 9/10 273/157 R |
| 6,012,718 | A | * | 1/2000 | McClellan | A63F 9/10 273/157 R |
| 6,024,360 | A | * | 2/2000 | Orbach | A63F 9/10 273/157 R |
| 8,910,942 | B2 | * | 12/2014 | Cohen | A63F 9/10 273/157 R |

* cited by examiner

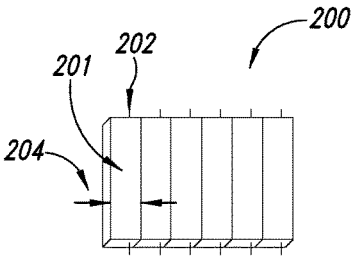
FIG. 12
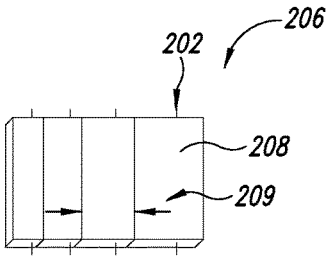
FIG. 13
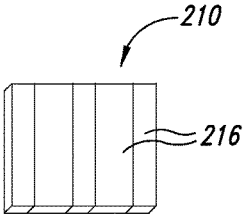
FIG. 14
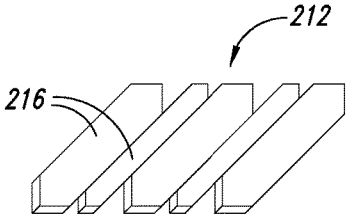
FIG. 15
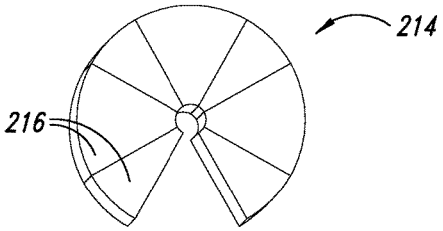
FIG. 16
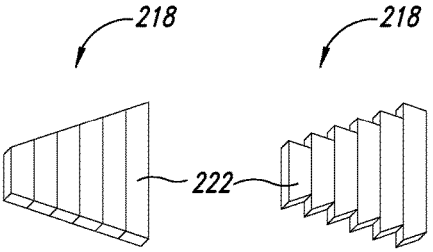
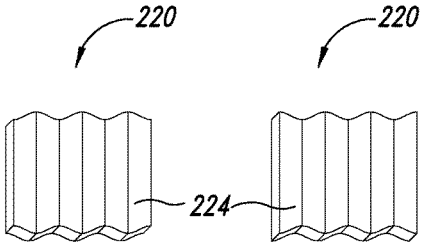
FIG. 17A FIG. 17B FIG. 18A FIG. 18B

PUZZLE SYSTEM WITH DUAL DISPLAY FACES

BACKGROUND

Technical Field

The present disclosure pertains to display signage and, more particularly, to an articulated sign system having rotatable panels with voids that cooperate in response to rotation of the panels to display characters on dual display faces as well as to a dual-sided puzzle system employing the use of voids.

Description of the Related Art

There exist today several devices that can be used to display messages, ranging from single sided billboards to more complex sign systems involving movable panels. These systems do not utilize or suggest the use of interlocking movable panels that use voids to display alternative messaging on opposing sides of the panels.

BRIEF SUMMARY

The present disclosure is directed to a mechanical sign system and method of making that provides dual display faces composed of a plurality of rotatable panels having voids that cooperate to display the outline of one or more characters.

In accordance with one aspect of the present disclosure, a signage system is provided having at least one support, a housing mounted on the at least one support, a plurality of panels rotatably mounted in the housing and configured to present first and second display faces, each panel having first and second opposing faces that meet at opposing longitudinal first and second edges, the plurality of panels including a first panel having a portion of a first character removed from the first edge of the first panel, a second panel having a remaining portion of the first character removed from the second edge of the second panel, the first and second panels cooperating so that when the first and second panels are rotated with the respective first and second edges adjacent each other, the portion of the first character on the first panel and the remaining portion of the first character on the second panel cooperate to form a visual display of the complete first character. The system further includes a mechanism coupled to the plurality of panels and configured to cause the plurality of panels to rotate in unison in the housing and change the display face from the first display face to the second display face and vice versa.

In accordance with another aspect of the present disclosure, the second edge of the first panel has a portion of a second character removed from the second edge and the first edge of the second panel has the remaining portion of the second character removed therefrom, the portion of the second character on the first panel and the remaining portion of the second character on the second panel cooperate when the second edge of the first panel and the first edge of the second panel are adjacent each other to form a visual display of the complete second character.

In accordance with a further aspect of the present disclosure, the system includes a third panel adjacent the first panel in the housing and a fourth panel adjacent the second panel in the housing, each of the third and fourth panels having respective first and second opposing faces that meet at opposing longitudinal first and second edges, the third panel having a portion of a third character removed from the first edge of the third panel and the second edge of the first panel having a remaining portion of the third character removed therefrom so that when the second edge of the first panel is adjacent the first edge of the third panel, the third character is displayed. The fourth panel has a first portion of a fourth character removed from the second edge thereof and the second panel have a remaining portion of the fourth character removed from the first edge of the second panel so that when the second edge of the fourth panel is adjacent a second edge of the second panel, the completed fourth character is displayed.

In accordance with still yet another aspect of the present disclosure, the system includes a fifth panel adjacent the third panel in the housing and a sixth panel adjacent the fourth panel in the housing, each of the fifth and sixth panels having respective first and second opposing faces that meet at opposing longitudinal first and second edges, the fifth panel having a portion of a fifth character removed from the first edge of the fifth panel and the second edge of the third panel having a remaining portion of the fifth character removed therefrom so that when the second edge of the third panel is adjacent the first edge of the fifth panel, the fifth character is displayed. The sixth panel has a first portion of a sixth character removed from the second edge thereof and the fourth panel have a remaining portion of the sixth character removed from the first edge of the fourth panel so that when the second edge of the sixth panel is adjacent a second edge of the fourth panel, the completed sixth character is displayed.

In accordance with another aspect of the present disclosure, the first edge of the first panel and the second edge of the second panel interlock when they are adjacent each other.

In accordance with another implementation of the present disclosure, a puzzle is provided that includes a plurality of puzzle panels configured to present first and second complete puzzle faces when assembled in a respective first and second configuration. The plurality of puzzle panels includes a first panel having a portion of a first character removed from the first edge of the first panel; a second panel having a remaining portion of the first character removed from the second edge of the second panel; the first and second panels cooperating so that when the first and second panels are positioned with the respective first and second edges adjacent each other, the portion of the first character on the first panel and the remaining portion of the first character on the second panel cooperate to form a visual display of a complete first character.

In accordance with another aspect of the foregoing implementation, a frame is provided that is sized and shaped to receive the plurality of panels and hold the plurality of panels in abutting relationship. Ideally the frame has a first side and an opposing second side, with the frame structured to hold the plurality of panels on the first side to display the first character and to hold the plurality of panels on the second side to display the second character.

BRIEF DESCRIPTION OF THE SEVERAL VIEWS OF THE DRAWINGS

The foregoing features and advantages of the present disclosure will be more readily appreciated as the same become better understood from the following detailed description when taken in conjunction with the accompanying drawings, wherein:

FIGS. 12-13 are isometric illustrations of vertical panel systems with offset axles;

FIGS. 14-16 are isometric illustrations of vertical, diagonal and radial systems of panels of non-uniform width;

FIGS. 17A-17B illustrate a single system pictured in each of the dual display faces;

FIGS. 18A-18B are illustrations of yet another single system pictured in each of the dual display faces;

FIGS. 24-25 are isometric illustrations of systems where panels of distinctly different shapes are fully contained within their respective frames in which FIG. 24 is linear while FIG. 25 is radial.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with motors, sign supports, and housings have not been shown or described in order to avoid unnecessarily obscuring descriptions of the implementations.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

Figure 1A:
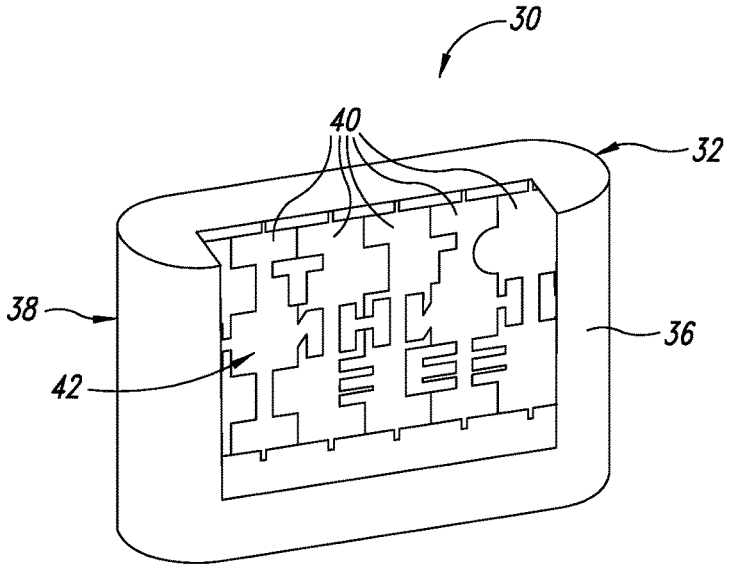
FIGS. 1A and 1B are isometric illustrations of a sign system formed in accordance with the present disclosure showing rotatable dual display faces.
Figure 1B:
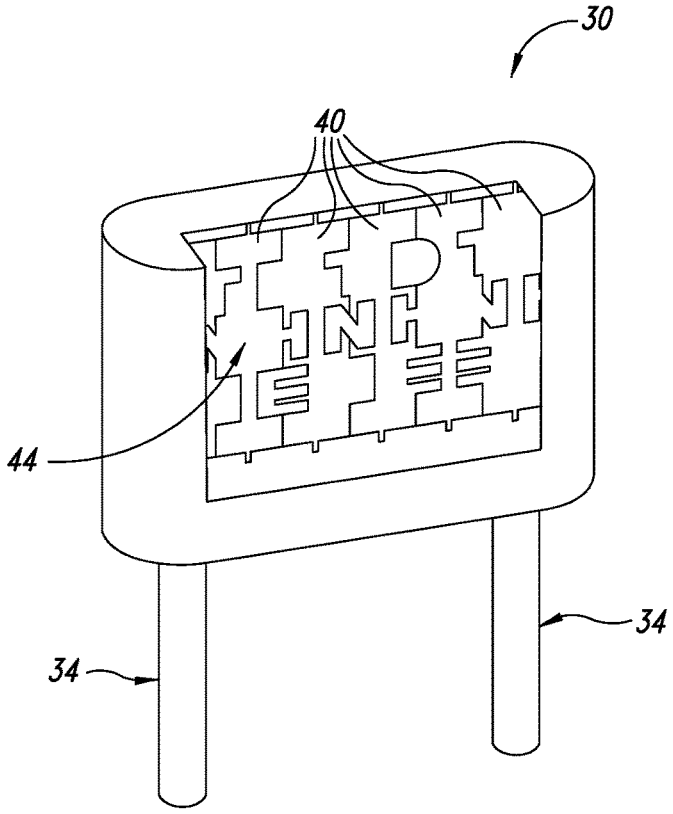

FIGS. 1A-1B illustrate representative implementations of a sign system 30 formed in accordance with the present disclosure. FIG. 1A illustrates an implementation of the system 30 with a housing 32 and without individual supports. This configuration could be used for direct mounting of the system 30 to the side of a building or other structure. In FIG. 1B two supports 34 are provided, which can be used to support the housing 32 in a free-standing manner. In both implementations, the system 30 includes the housing 32 having a front side 36 and rear side 38. A plurality of panels 40 are rotatably mounted in the housing 32 to rotate about a longitudinal axis of each panel 40. The plurality of panels 40 cooperate to present dual display faces 42, 44 that are alternatingly visible through the front side 36 of the housing 32.

Figure 2:
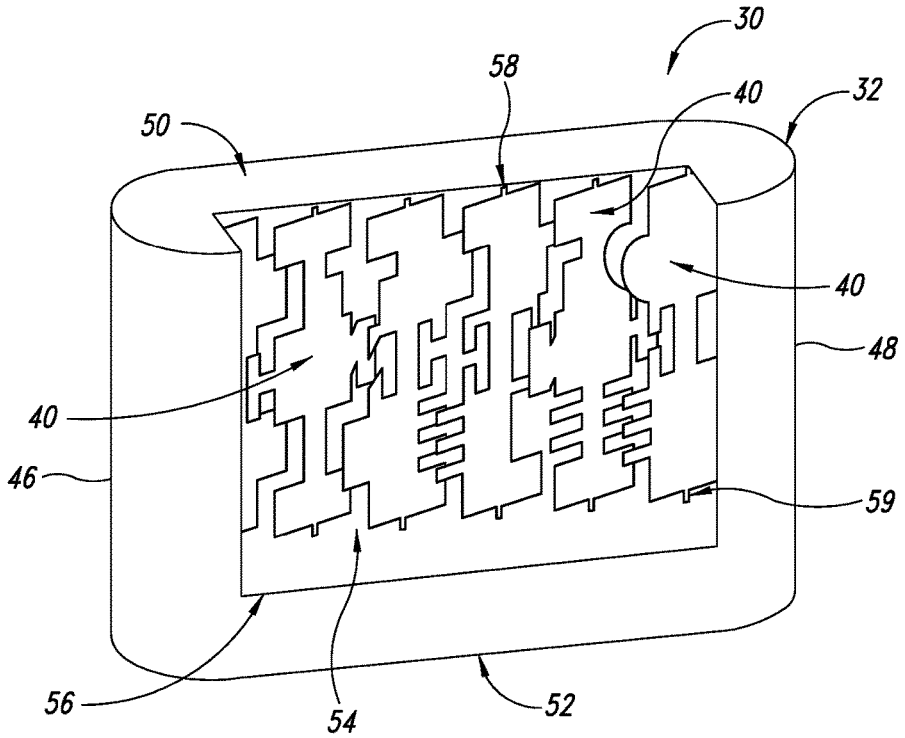
FIG. 2 is a cutaway isometric view of the sign system of FIGS. 1A and 1B showing the internal structure thereof.

FIG. 2 is an enlarged view of the sign system 30 depicted in FIG. 1A with the panels 40 partially rotated. It is to be understood that the following description of FIG. 2 will apply equally to FIG. 1B. As shown in FIG. 2, the housing 32 is illustrated as a single structure having integral side walls 46, 48, a top wall 50, and a bottom wall 52. It is to be understood that the housing 32 can be formed in a variety of configurations without departing from the scope of the disclosure, such as individual side walls, top wall, and bottom wall or combinations of discreet walls and integral walls. The sidewalls 46, 48, top wall 50, and bottom wall 52 define an interior 54 sized and shaped to house the panels 40, which are shown partially rotated between the dual display faces. The housing 32 has an open front 56 that may or may not be covered with a transparent wall.

The panels 40 are rotatably mounted in the housing 32 to individually rotate about their individual longitudinal axis. In the implementation shown in FIG. 2 the longitudinal axis of the panels 40 is parallel to or substantially parallel to the side walls 46, 48. Each panel 40 has first and second longitudinally aligned axles 58, 59 extending in opposite directions from the terminal ends of each panel 40.

Figure 3:
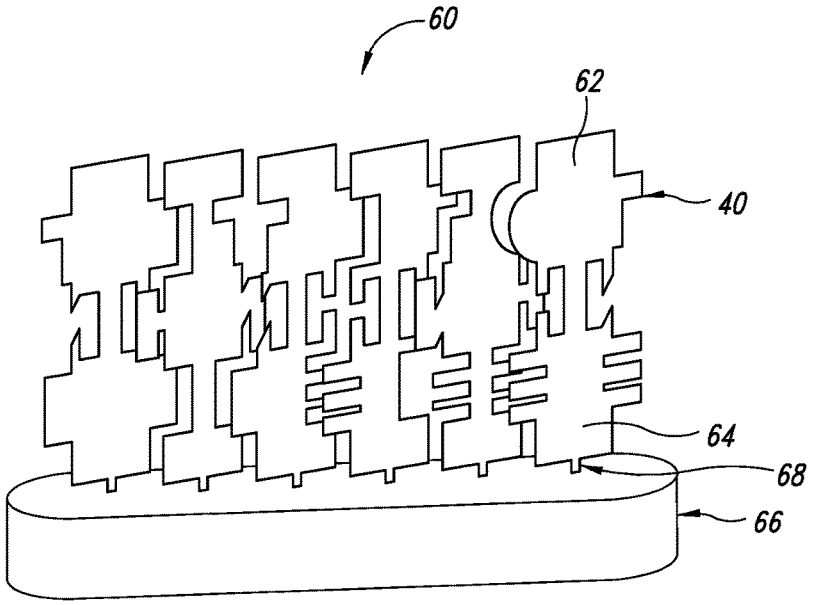
FIG. 3 is an isometric view of another implementation of the sign system in which the panels have a free-standing top end.

FIG. 3 is an isometric view of another implementation of a sign system 60 in which the panels 40 have a free-standing distal end 62 and an opposing end 64 rotatably attached to a base 66 by an axle 68. Located within the base 66 is a mechanism to rotate the panels 40 about their longitudinal axis, either clockwise or counter-clockwise or both. In one implementation the panels 40 first rotate in a first direction 180 degrees (clockwise or counter-clockwise), then counter-rotate in a second direction opposite to the first direction (counter-clockwise or clockwise) to return to the starting position. While not shown in FIG. 3, the panels 40 may also rotate both clockwise and counterclockwise simultaneously, e.g., the first, third and fifth panels rotate clockwise as viewed from the top while the second, fourth, and sixth panels rotate counterclockwise.

Figure 4:
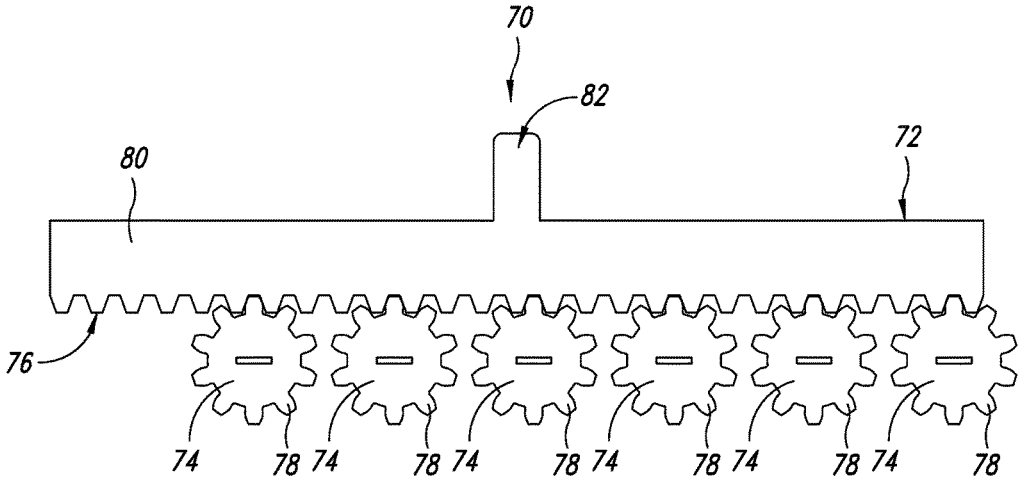
FIG. 4 is a top plan view of a representative implementation of a mechanical assembly configured to rotate the panels formed in accordance with the present disclosure.

FIG. 4 is a top view of a representative implementation of a mechanical assembly 70 configured to rotate a plurality of the panels in accordance with the present disclosure. A rack 72 and (multiple) pinion 74 assembly is provided as one practical solution for reciprocating (rotational) movement of the panels. The rack 72 contains a plurality of teeth 76 extending outward in a conventional fashion from an elongate bar 80. The plurality of pinions 74 have teeth 78 that engage with the teeth 76 on the rack 72. A means for a user to manually operate the assembly is provided in the form of a handle 82 that extends from the bar 80 in a direction opposite that of the teeth 76. The rack 72 can be manually reciprocated to the left and right when viewed from the top in FIG. 4, causing the pinions 74 to alternatingly rotate clockwise and counter-clockwise. The panels would have their individual axles connected to a respective pinion 74 such that the panel would rotate with the pinion 74.

Figure 5:
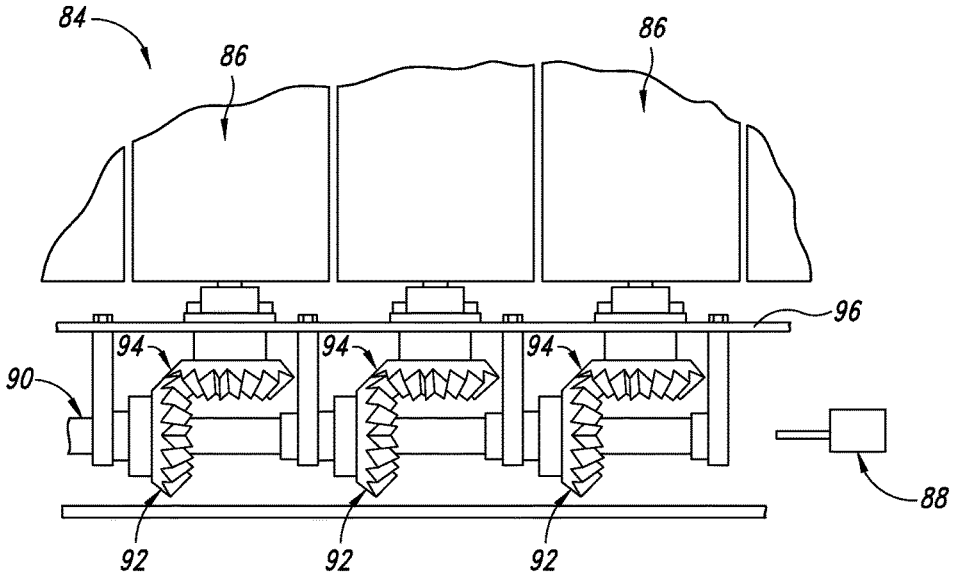
FIG. 5 is a front plan view of a representative implementation of a mechanical assembly configured to rotate the panels formed in accordance with the present disclosure.

FIG. 5 is a front view of a representative implementation of a mechanical assembly 84 configured to rotate a plurality of panels 86 in accordance with the present disclosure. Here, a prime mover 88, such as an electric motor, is mechanically coupled to a main shaft 90 having a plurality of first beveled gears 92 in spaced relationship to rotate in unison with the shaft 90. Meshing with these first beveled gears 92 are a plurality of second beveled gears 94 rotatably mounted in spaced relationship to a frame plate 96 and fixed to a respective panel 86. As the prime mover 88 rotates the shaft 90, the first beveled gears 92 rotate the second beveled gears 94, which in turn rotate the panels 86.

It is to be understood that the present disclosure can also be implemented in the form of a puzzle system in which an image to be displayed is formed from a plurality of unmounted panels, free-form puzzle pieces that can be but are not required to be interlocking, or that can be but are not required to be assembled within a frame. More details regarding one form of this implementation of a puzzle system 100 are provided below in conjunction with FIGS. 6A-6E.

Figure 6A:
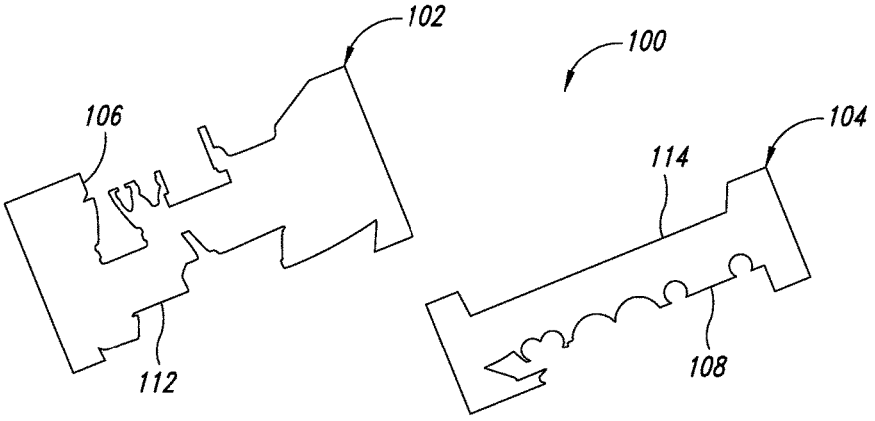
FIG. 6A-6E illustrate a puzzle system utilizing a pair of uncontained panels that when combined comprise a puzzle that can be assembled in two distinct ways—each revealing one of two secret void patterns—along with optional double-sided frame trays that may accompany loose puzzle panels in order to contain them.

FIG. 6A is an illustration of a pair of loose, uncontained panels 102, 104. Each of the panels 102, 104 comprises a portion of an image formed from missing material from the panels 102, 104. This missing material can be visualized from first and second outlines 106, 108 of a first image 110 (shown completed in FIG. 6D) and a third and fourth outlines 112, 114 of a second image 116 (shown completed in FIG. 6E). When combined but not connected, the panels 102, 104 comprise a completed puzzle that can be assembled in two ways according to dual display faces for the two images 110, 116 as described more fully below. This illustrated example is cut to reveal the image of a train 110 on one display face and the image of a boat 116 on the other.

As discussed herein, these images 110, 116 are formed by the removal of material from the panels 102, 104. As such, the images 110, 116 are formed by the voids left by the missing material. These voids are sometimes referred to herein as "negative space" similar to a photograph negative in which the image to be viewed is an outline formed by the clear portion of the negative.

Figure 6B:
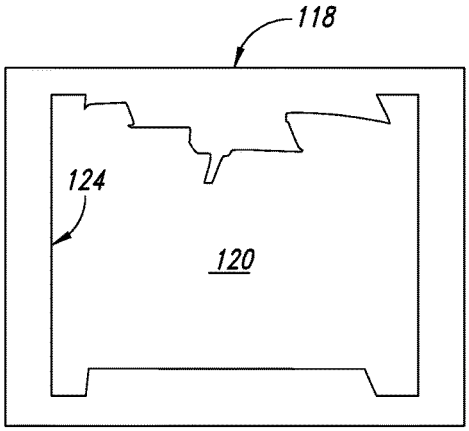
Figure 6C:
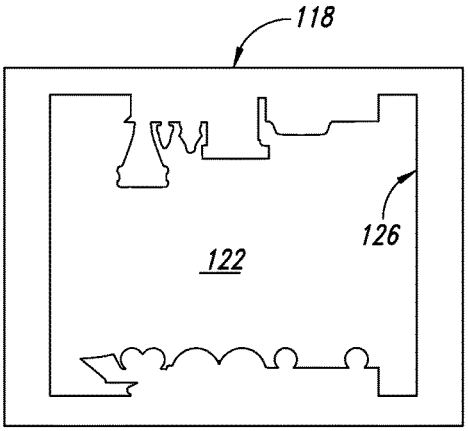

FIGS. 6B and 6C illustrate opposing display faces of an optional frame 118 that may accompany the loose puzzle panels 102, 104 in order to contain them as part of the system 100. The frame 118 may be double sided to have opposing display faces 120, 122 and have two distinct borders 124, 126 that are sized and shaped to mate with or in some cases interlock with the jagged outer puzzle panel edges that form the first through fourth outlines 106, 108, 112, 114 when assembled in both of the two display faces 120, 122.

Figure 6D:
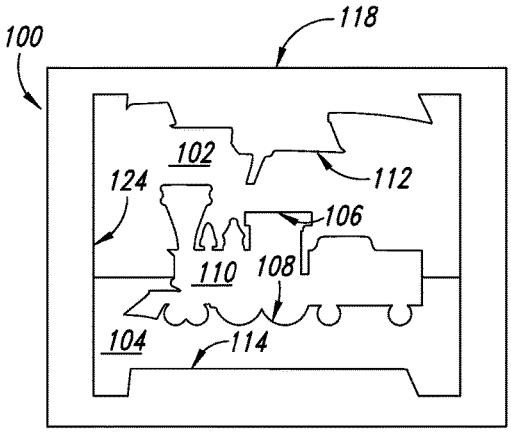
Figure 6E:
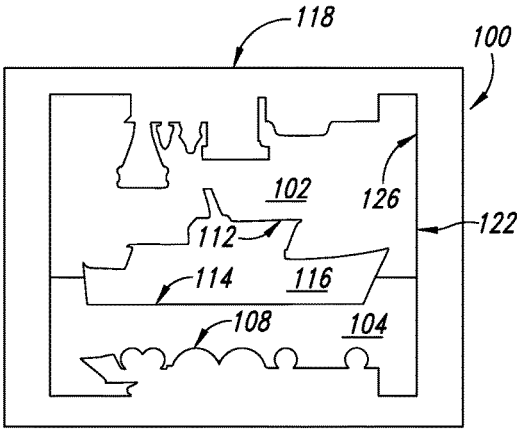

In FIG. 6B, the first display face 120 of the frame 118 is shown formed by the border 124 related to the outline of a boat. In FIG. 6C, the second display face 122 of the frame 118 is shown formed by the border 126 related to the outline of a train. In FIG. 6D, the panels 102, 104 are assembled in the first display face 120 such that an image 110 of a train is visible where the material has been removed. The image 110 of the train is formed by the first and second outlines 106, 108 facing each other while the third and fourth outlines 112, 114 mate with the corresponding border 124. In FIG. 6E, the panels 102, 104 are assembled in the second display face 122 such that an image 116 of a boat is visible where the material has been removed. The image 116 of the boat is formed by the third and fourth outlines 112, 114 facing each other while the first and second outlines 106, 108 mate with the corresponding border 126.

Regardless of the orientation of the panels (and in the case of rotatable panels, the orientation of the axles), only two voided characters can occupy any designated area running perpendicular to the longitudinal axis of the panel—one for each of the images or display faces. For instance, in vertical axle format only one character can occupy each designated horizontal row on the first display face (which is why words are written diagonally in this format). The character position is where a character is fully void on the display face and is determined by the left negative-half aligning with the right negative-half when the two edges are touching, to create a whole negative in a vertical orientation. It may also be noted that the voided character in the second display face can share the exact position as the voided character in the first display face or can be positioned two edges away from the character in the first display in either direction. It is impossible for the second voided character to appear one edge left or right because the edges of those positions must cooperate to obscure the character in the first display face unless the left or right half of the voided character is used in both display faces and is thus never filled by an opposite positive cooperating edge.

Figure 7A:
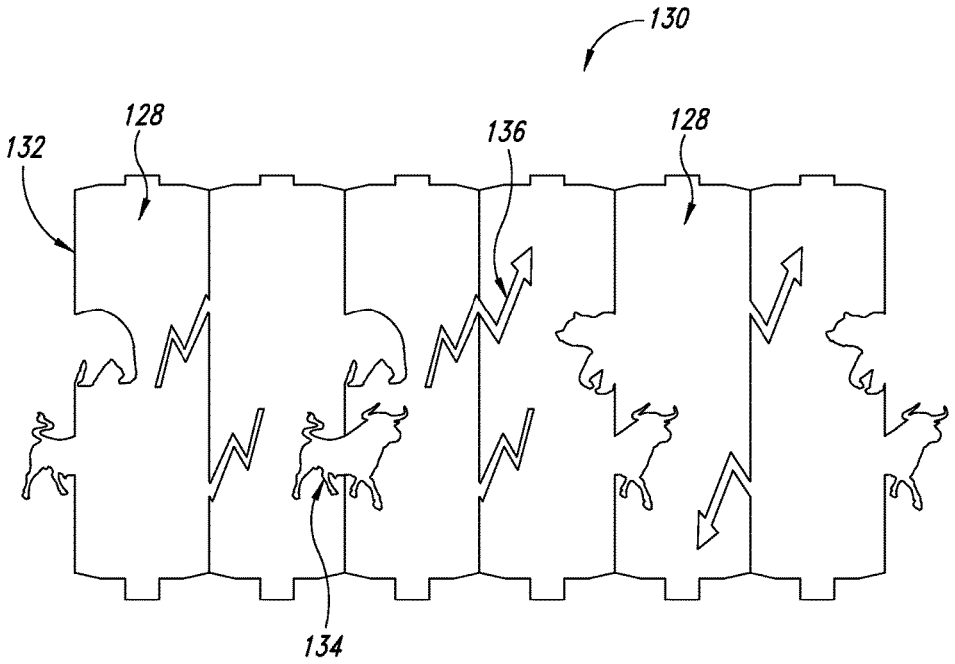
FIG. 7A-7B are illustrations of a display panel configured to have alternating displays of a bull with an up arrow on a first display and a bear with a down arrow for a second display.
Figure 7B:
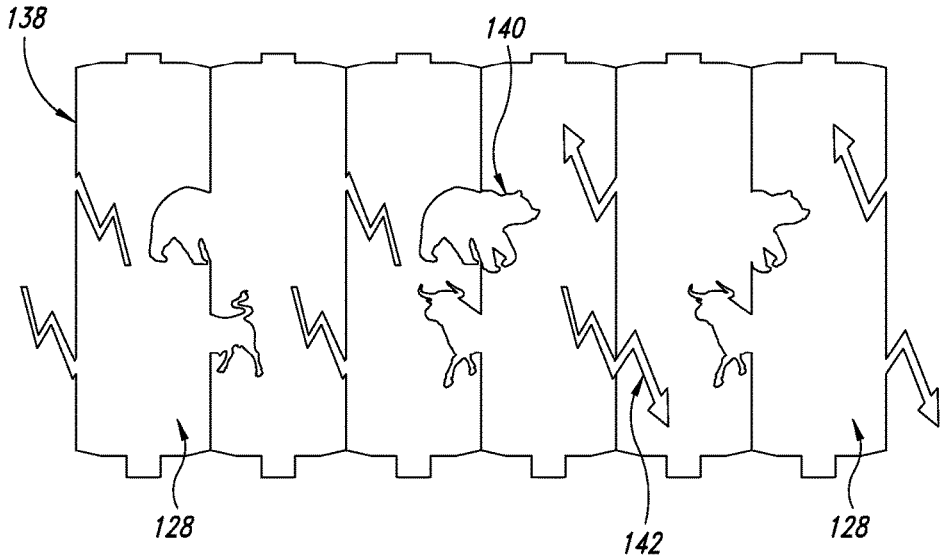

For instance, in FIGS. 7A and 7B, a "Stock Market" theme display 130 is illustrated in a plurality of rotatable panels 128. In the first display face 132 shown in FIG. 7A, an image of a bull 134 is on a bottom designated character row and an up arrow 136 is positioned diagonally above and to the right of the image of the bull 134. When the panels 128 are rotated to a second display face 138 shown in FIG. 7B, it is impossible for the bear 140 to appear above the bull 134 with the down arrow 142 below the up arrow 136 because these positions are adjacent to voided characters in the first display face 132. The bear 140 appears in the same position as the up arrow 136 and the down arrow 142 appears diagonally down to the right from the bear 140, which is two edges to the right of voided bull 134. To keep the whole scene (the combined display faces) centered, it is necessary to add a panel on one end and make the viewing area one panel wider (with the first display face characters slightly off center to the left while the second display face characters are slightly off center to the right).

Figure 8A:
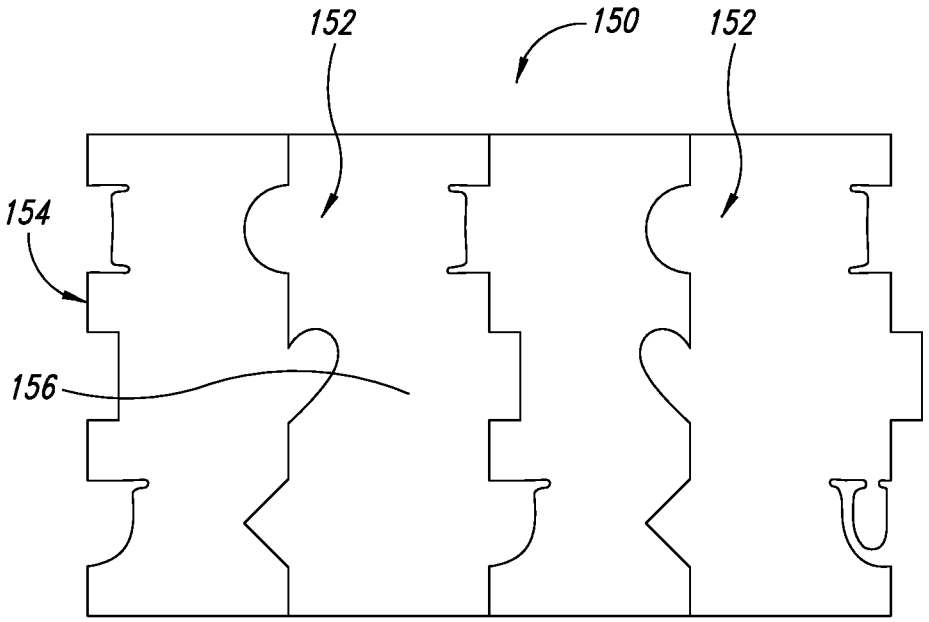
FIGS. 8A-8B are illustrations of a series of uncontained panels that when combined comprise a puzzle that can be assembled in two distinct ways, the first display face revealing a solid sheet and the second display face revealing void characters.
Figure 8B:
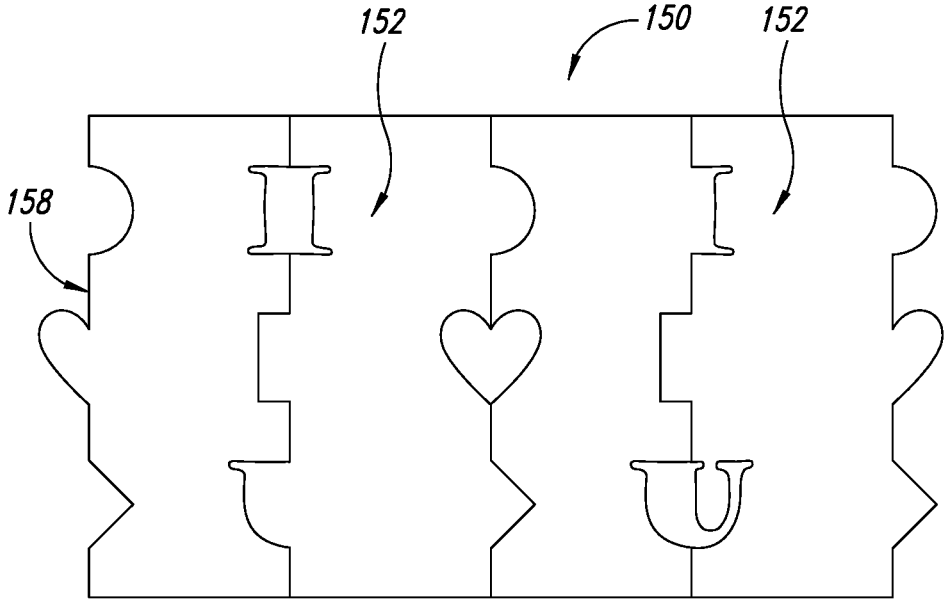

It is to be understood that panels may also be cut to reveal void characters in only one of the two display faces so that when assembled in the other display face the puzzle will form a solid sheet for writing or etching a message or other indicia. This configuration may be used to present a greeting card puzzle with a secret message. FIGS. 8A and 8B illustrate a single display face sign or puzzle system 150 having four assembled panels 152 that form in a first display face 154 shown in FIG. 8A a solid sheet 156 in which to write a greeting. In FIG. 8B the panels 152 have been rotated 180 degrees about a vertical axis to show a second display face 158 showing the cryptic message: "I love you".

Figure 9A:
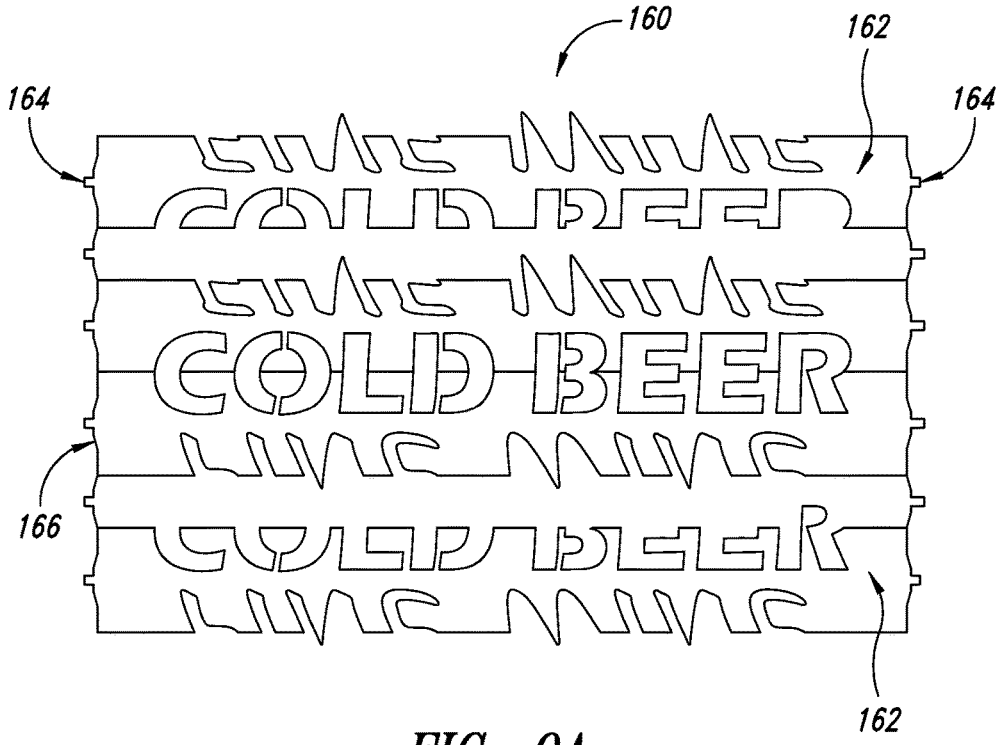
FIGS. 9A-9B are isometric illustrations of a sign system formed in accordance with the present disclosure showing panels arranged in horizontal orientation.
Figure 9B:
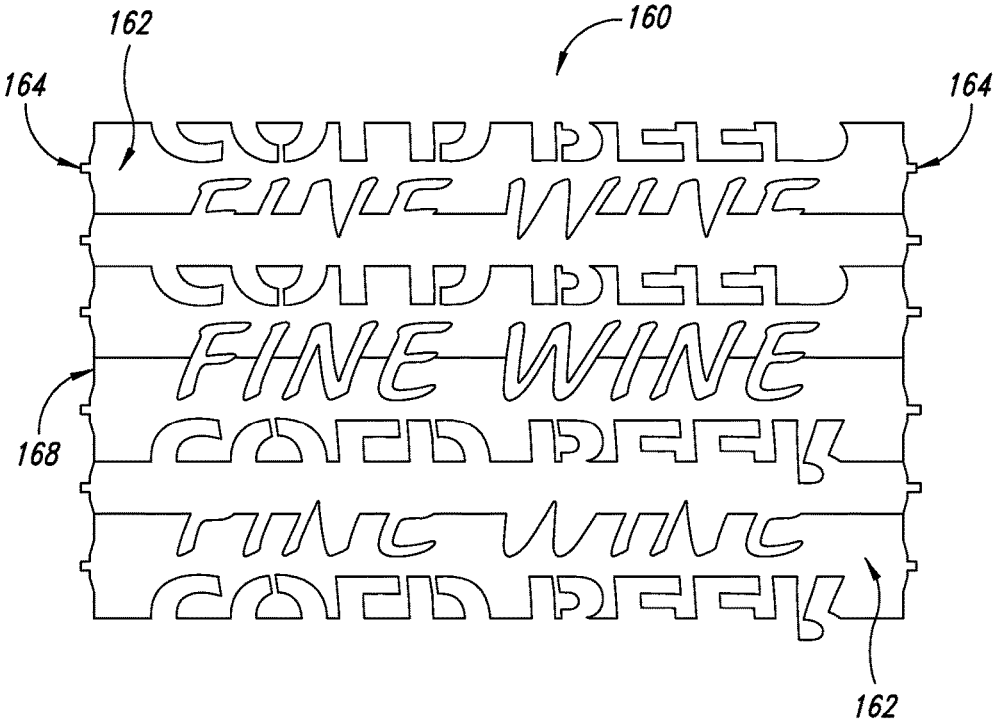

FIGS. 9A-9B are illustrations of a sign system 160 formed in accordance with the present disclosure showing panels 162 and axles 164 arranged in a horizontal orientation. The panels 162 have a first display face 166 with the words "COLD BEER" and a second display face 168 that displays the words "FINE WINE" in stylized font. The orientation of the panels in a horizontal arrangement is constructed and formed as the embodiment described above with the panels in a vertical orientation.

Figure 10A:
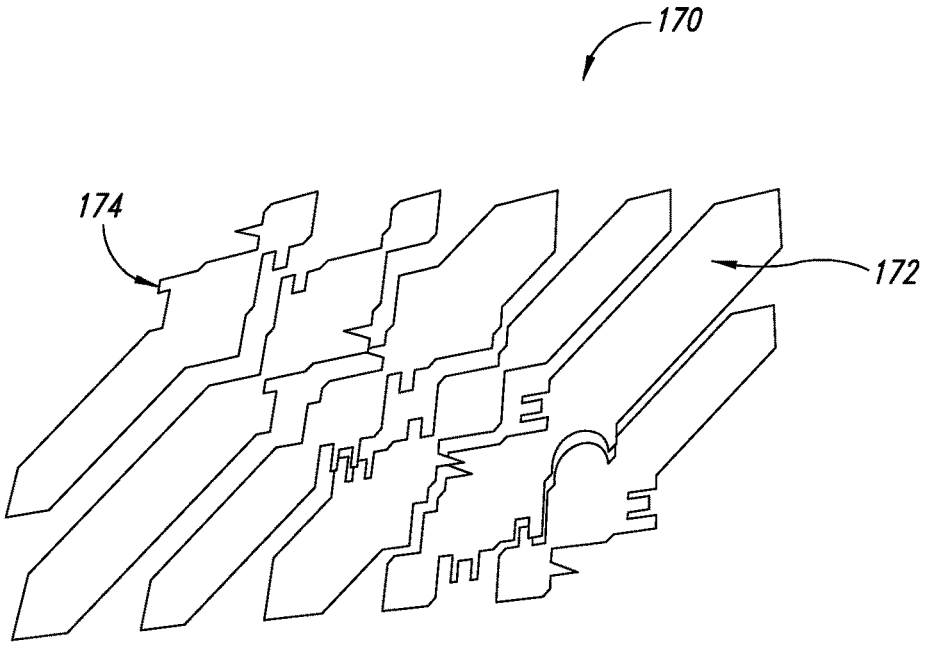
FIGS. 10A-10B are isometric illustrations of a sign system formed in accordance with the present disclosure showing panels arranged in diagonal orientation.
Figure 10B:
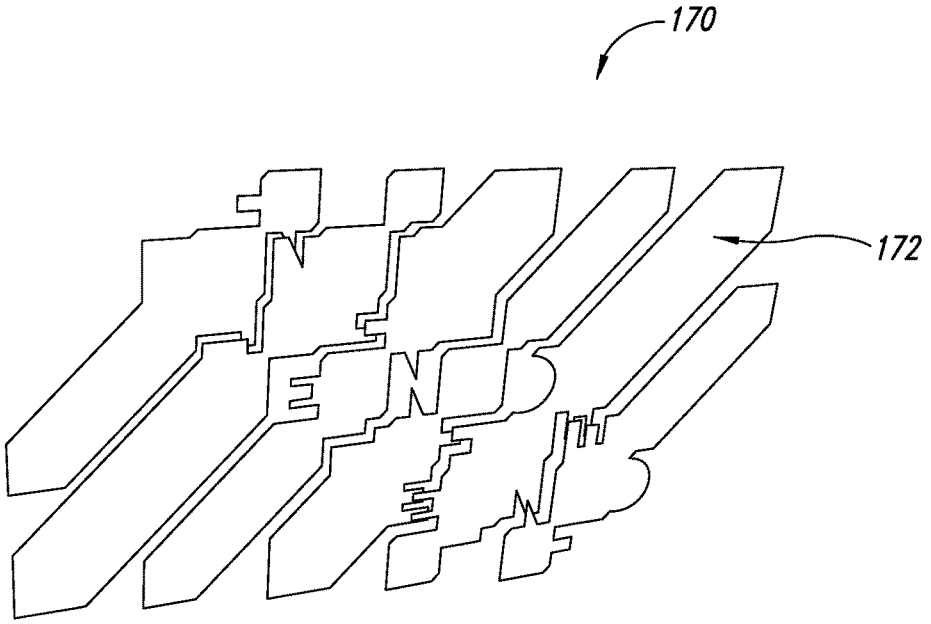

FIGS. 10A-10B are illustrations of a sign system 170 formed in accordance with the present disclosure showing panels 172 arranged in diagonal orientation. In FIG. 10A the first display face 174 displays the word "THE," and in FIG. 10B the panels 172 are partially rotated to show the orientation of the panels 172 and the voids that form the displays. The word "END" is displayed on the second display face once the panels are fully rotated.

Figure 11A:
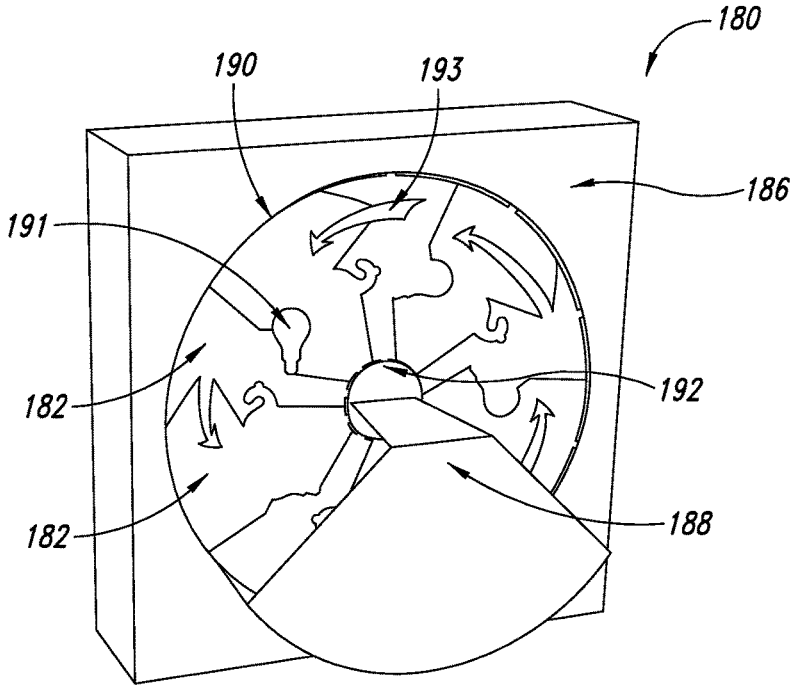
FIGS. 11A-11B are isometric illustrations of a sign system formed in accordance with the present disclosure showing panels orientated as an array.
Figure 11B:
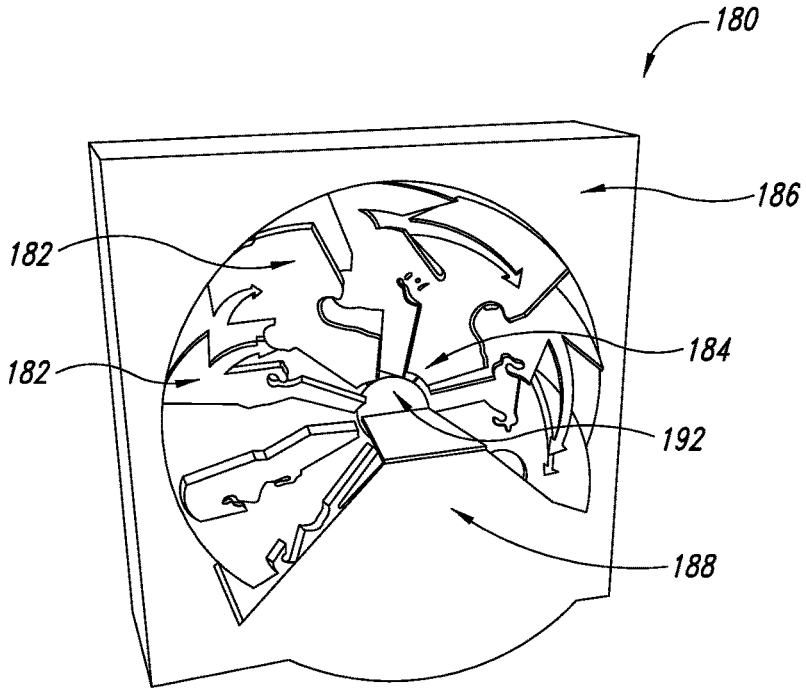

FIGS. 11A-11B are isometric illustrations of a sign system 180 formed in accordance with the present disclosure showing panels 182 and axles 184 orientated in a circular array within a housing 186. The housing 186 includes a protruding section 188 specifically designed to hide the two jagged, unconnected ends of the array. In the first display face 190 of FIG. 11A a light bulb 191 and left arrow 193 are shown. In FIG. 11B the panels 182 are partially rotated to show the points of rotation. In this case, the center 192 of the housing 186 supports the interior axel 184. In this design, the second display face displays an arrow pointing to the right at the same place the left arrow 193 is in the first display face. There is a dollar sign ($) below and to the right—symmetrically opposite where the light bulb 191 is in the first display face. The message of this system 180 is that good ideas turn into money. In FIG. 11B the panels are shown rotating in different directions as described above in connection with FIG. 3. In other words, alternating panels will rotate in opposite directions. This is one option for rotating the panels to the previous description in which all panels rotate simultaneously in the same direction about their longitudinal axis.

FIGS. 12-25 are a non-comprehensive sample of varying panel shapes that can be applied to previously described mechanical signs or puzzles in order to adjust the complexity or visual impact of the end product.

Specifically, FIGS. 12-13 are isometric illustrations of vertical panel systems 200 with panels 201 having offset axles 202 that transform the dual display faces horizontally in reciprocating fashion in order to adjust the complexity or visual impact of the end product. FIG. 12 shows the panels 201 to have a uniform width 204 (measurement of panel perpendicular to the axis). FIG. 13 shows a workable system 206 of panels 208 with offset axels 202, and with the panels 208 of a non-uniform width 209 as among the panels.

FIGS. 14-16 are isometric illustrations of vertical, diagonal and radial systems 210, 212, 214 respectively of panels 216 of non-uniform width; the shape, aspect ratio and position of the perimeters of these viewing planes remain unchanged between the dual display faces.

FIGS. 17A-17B and 18A-18B are isometric illustrations of linear systems 218, 220 with panels having uneven, inconsequential outer edges (as relating to the shared edges that cooperate to reveal voids). FIGS. 17A-17B illustrate a single system 218 with panels 222 pictured in each of the dual display faces. FIGS. 18A-18B are illustrations of the other single system 220 with panels 224 pictured in each of the dual display faces. The perimeters in the systems 218, 220 of these viewing planes change between the dual display faces.

Figure 19:
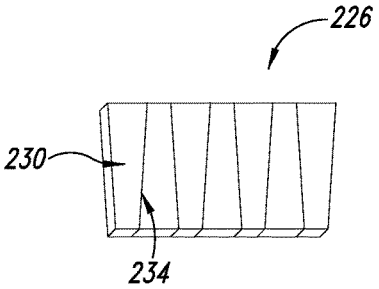
FIGS. 19-20 are isometric illustrations of linear systems with bilaterally symmetrical panels having nonparallel shared edges.
Figure 20:
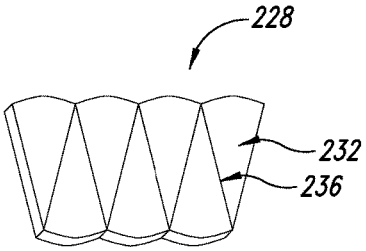

FIGS. 19-20 are isometric illustrations of linear systems 226, 228 with bilaterally symmetrical panels 230, 232 respectively with nonparallel shared edges 234, 236 respectively. The perimeters of these viewing planes remain unchanged between the dual display faces.

Figure 21A:
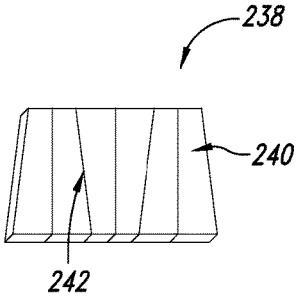
FIGS. 21A-21B are isometric illustrations of a single linear system having nonparallel shared edges in which the panels are not bilaterally symmetrical.
Figure 21B:
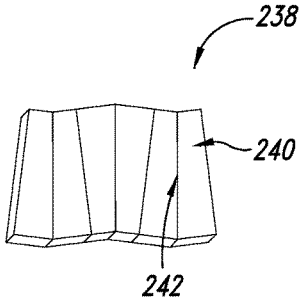

FIGS. 21A-21B are isometric illustrations of a single linear system 238 having panels 240 with nonparallel shared edges 242 in which the panels are not bilaterally symmetrical. The perimeter of the viewing plane changes between the dual display faces in FIGS. 21A and 21B.

Figure 22:
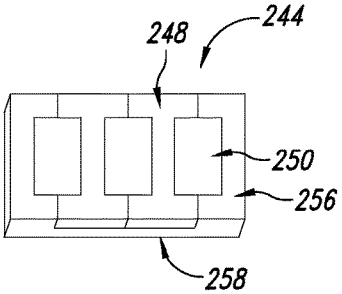
FIGS. 22-23 are isometric illustrations of linear systems in which panels are distinctly different shapes and contained in partial frames.
Figure 23:
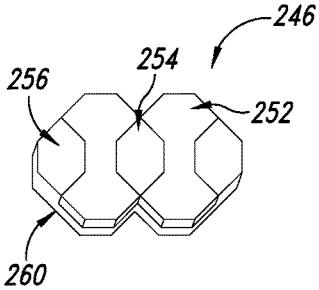

FIGS. 22-23 are isometric illustrations of linear systems 244, 246, respectively, in which panels 248, 250 in FIG. 22 and panels 252, 254 in FIG. 23 are distinctly different shapes and are contained in partial frames 256. The illustrations showing the partially contained panels also act to complete the framing 258, 260, respectively, which imparts structural integrity to the completed puzzle.

Figure 24:
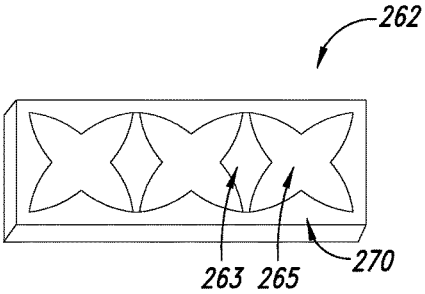
Figure 25:
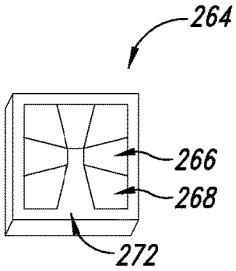

FIGS. 24-25 are isometric illustrations of systems 262, 264 in which panels 263, 265 in FIG. 24 and 266, 268 in FIG. 25 are of distinctly different shapes and are fully contained within their respective frames 270, 272. FIG. 24 is linear while FIG. 25 is radial.

The various implementations described above can be combined to provide further implementations. Aspects of the implementations can be modified, if necessary to employ concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A puzzle, comprising: a plurality of puzzle panels configured to present first and second complete puzzle faces when assembled in a respective first and second configuration, the plurality of puzzle panels including:

a first panel having a portion of a first character removed from the first edge of the first panel;

a second panel having a remaining portion of the first character removed from the second edge of the second panel;

the first and second panels cooperating so that when the first and second panels are positioned with the respective first and second edges adjacent each other, the portion of the first character on the first panel and the remaining portion of the first character on the second panel cooperate to form a visual display of a complete first character.

2. The puzzle of claim 1, wherein the second edge of the first panel has a portion of a second character removed from the second edge and the first edge of the second panel has the remaining portion of the second character removed therefrom, the portion of the second character on the first panel and the remaining portion of the second character on the second panel cooperate when the second edge of the first panel and the first edge of the second panel are adjacent each other to form a visual display of a complete second character.

3. The puzzle of claim 1, wherein the panels are pie shaped and the plurality of panels are sized and shaped to form a circular arrangement when positioned adjacent each other.

4. The puzzle of claim 3 wherein the plurality of panels cooperate to form a first circular face and to form a second circular face when the panels are rotated about a longitudinal axis and positioned adjacent each other, with the first character visible on the first circular face and a second character visible on the second circular face.

5. The puzzle of claim 2, further comprising a frame sized and shaped to receive the plurality of panels and hold the plurality of panels in abutting relationship.

6. The puzzle of claim 5 wherein the frame has a first side and an opposing second side, the frame structured to hold the plurality of panels on the first side to display the first character and to hold the plurality of panels on the second side to display the second character.

7. The puzzle of claim 1 wherein when the second edge of the first panel and the first edge of the second panel are adjacent each other a solid display face is formed with no visual display.

* * * * *